United States Patent [19]

Rodth

[11] 4,270,673

[45] Jun. 2, 1981

[54] ELECTRIC GRAVITY DISPENSING VALVE

[75] Inventor: Joseph J. Rodth, Swansea, Mass.

[73] Assignee: Alco Foodservice Equipment Company, Miami, Fla.

[21] Appl. No.: 927,435

[22] Filed: Jul. 24, 1978

[51] Int. Cl.[3] ..... B67D 5/56

[52] U.S. Cl. ..... 222/129.3; 222/129.1; 222/133; 222/145; 222/146 C; 366/178; 137/606

[58] Field of Search ..... 222/129.1, 129.2, 129.3, 222/129.4, 133, 145, 146 C; 99/323.2; 366/154, 165, 167, 178, 177, 182; 137/606

[56] References Cited

U.S. PATENT DOCUMENTS

| | | | |
|---|---|---|---|
| 3,069,871 | 12/1962 | Johnson | 222/129.4 X |
| 3,800,826 | 4/1974 | McCann | 222/129.1 X |
| 3,966,091 | 6/1976 | Benclc | 222/129.1 |
| 4,128,190 | 12/1978 | Gruber | 222/129.2 |

FOREIGN PATENT DOCUMENTS

| | | | |
|---|---|---|---|
| 691569 | 5/1953 | United Kingdom | 222/129.1 |

*Primary Examiner*—Charles A. Marmor
*Attorney, Agent, or Firm*—Haight, Hofeldt, Davis & Jambor

[57] ABSTRACT

An electrically operated valve for effecting diffusion of a flow of pressurized diluent to substantially atmospheric pressure and mixing the diluent with a gravity flow of beverage concentrate in controlled proportions and dispensing a mixed beverage therefrom by gravity flow. Separate valving chambers are provided for the diluent and the concentrate flow and the valves are individually actuated by electric solenoids. A removable nozzle assembly is provided which includes a removable thin orifice plate for metering the flow of the concentrate for effecting complete mixing. A pressure responsive device is provided to give additional force biasing the concentrate valve to the closed position, thereby permitting the use of concentrates containing pulping liquid. A cross-flow passage is provided between the inlets for the diluent and concentrate valving chambers in order that opening of the diluent valve will drop the pressure on the pressure responsive device and permit the solenoid to open the concentrate valve. The valving chambers are formed of thermally insulating material, and tubular projections formed of heat conducting material are provided at the inlet of each valving chamber. The tubular projections terminate closely adjacent the valving chamber and permit the diluent and concentrate to be maintained at the desired temperature in the proximity of the valving chamber, such that upon opening of the dispensing valve, the initial mixed beverage is at the desired temperature.

3 Claims, 5 Drawing Figures

ELECTRIC GRAVITY DISPENSING VALVE

BACKGROUND OF THE INVENTION

The present invention relates to valve assemblies for dispensing beverages post-mixed from a liquid concentrate and a diluent such as beverages mixed from sugar syrups and carbonated water, fruit juices and water or pulpy citrus concentrate and water. Valves of this type include separate valves for controlling the flow of diluent from a pressurized source and the flow of concentrate, usually from a gravity flow supply tank. In the more common applications, the diluent and concentrate are chilled and maintained at a temperature of approximately 40–45 degrees Farenheit (4–10 degrees Centigrade). Precise control of the mixing of the diluent concentrate in the proper proportions is required in order to maintain the flavor and consistency of the mixed beverage. Examples of this type of valve are found in the well known soda fountain dispensers employed for automatic post-mixing and dispensing of carbonated beverages.

Where chilled beverages are to be dispensed, it has been found very difficult to maintain the beverage concentrate and diluent at the desired temperature in the valving chamber immediately adjacent the dispensing valves such that the temperature of the first drink dispensed after a dwell period is the same as the temperature of later dispensed drinks after diluent and concentrate had been flowing through the valving chamber for some period of time.

Where a single valve assembly is desired to be used for dispensing a number of different mixed beverages, as for example, carbonated sugar syrup beverages and beverages comprising a mixture of citrus concentrate and water, the mixing structure of the valve must be altered to accommodate the different mixing ratios required for the different drinks. In order to provide for this capability, previously known valves have required disassembly of the valve body structure for changing of the orifices for controlling the flow of diluent concentrate.

Another valve design previously employed for effecting mixing of concentrate and diluent has employed an adjustable diffuser for controlling the amount of carbonization of the diluent and such a device is described in U.S. Pat. No. 3,727,844 issued to Robert S. Bencic. Where it is desired to dispense post-mix beverages by mixing flavored sugar syrup concentrate and carbonated water diluent, the syrup concentrate may be supplied from either a pressurized source or from a gravity flow storage tank. However, where it is desired to dispense a beverage mixed from pulpy citrus concentrate and water as a diluent, it has been found necessary to provide a pressurization to the supply of pulpy concentrate to effect flow of the pulp through the mixing valves. Problems have arisen in this regard where a relatively small orifice is needed to control the flow of pulpy concentrate for mixing in the correct proportion with the diluent. The pulpy concentrate tends to accumulate and block the metering orifice. Furthermore, where only a low gravity head is available for pulpy concentrate flow, a relatively large flow passage through the concentrate valving chamber is required to effect proper flow. A larger flow passage requires a larger valve seat, which in turn, for a given valve closing spring, results in reduced surface pressure on the valve seating surface. Increasing the spring bias force necessitates more force from the power means and requires either a larger solenoid coil or more current flow and thus greater power consumption. Thus, it has long been desired to find a way to provide a post-mix dispensing valve capable of dispensing either flavored sugar or citrus pulp concentrate mixed beverages from a low pressure head source and with a low force/power actuator.

SUMMARY OF THE INVENTION

The present invention solves the above-described problems in one aspect by maintaining the concentrate and diluent in the desired chilled condition in the valve mixing chamber such that upon opening of the concentrate and diluent valve, the initially dispensed portion of mixed beverage is at the desired temperature. The body of the valve is formed of an insulating material and stainless steel tubes are provided in the inlet to the concentrate and diluent valve chambers with the tubes providing the flow path for the diluent and concentrate to a position closely adjacent the valving chambers. Thus, the heat conducting metal tubes maintain the diluent and concentrate respectively at the desired temperature of the source such that upon opening of the diluent and concentrate valves, the initially dispensed mixed beverage is at a temperature substantially the same as that of the diluent and concentrate source.

In addition, problems have been encountered in providing sufficient closing force to shut off flow of pulpy citrus concentrate, yet enable opening of the valve against the closing bias by a solenoid of relatively small size and low power consumption. The present invention thus provides a unique beverage mixing and dispensing valve which is power operated and which maintains the desired temperature of the diluent and concentrate in the valving chambers prior to mixing and gravity discharge therefrom so as to insure that the initially dispensed mixed beverage upon opening of the diluent and concentrate valve is at the desired temperature.

In another aspect the unique dispensing valve assembly of the present invention is capable of metering and maintaining the diluent to concentrate ratio of not only flavored sugar syrup concentrates, but is also capable of proportioning and dispensing pulpy liquid citrus concentrates. The present dispensing valve assembly employs a cross-flow passage from the inlet of the pressurized liquid diluent and a means responsive to the diluent pressure to provide additional biasing of the concentrate valve which enables the valve to close with pulpy concentrate in the valving chamber. Upon opening of the diluent valve, the biasing pressure is bled off through the diluent valve and the power actuator is then capable of opening the concentrate valve.

In another aspect the present invention also provides a unique removable diffuser and mixing nozzle assembly employing a thin orifice plate which is readily interchangeable for varying the metering orifice size as required for different beverage mixing ratios. The nozzle assembly may be removed for changing the orifice plate and cleaning the diffuser without disturbing the liquid in the valving chambers and without requiring disconnection of the valve assembly from the source of diluent or concentrate.

DETAILED DESCRIPTION

Figure 1:
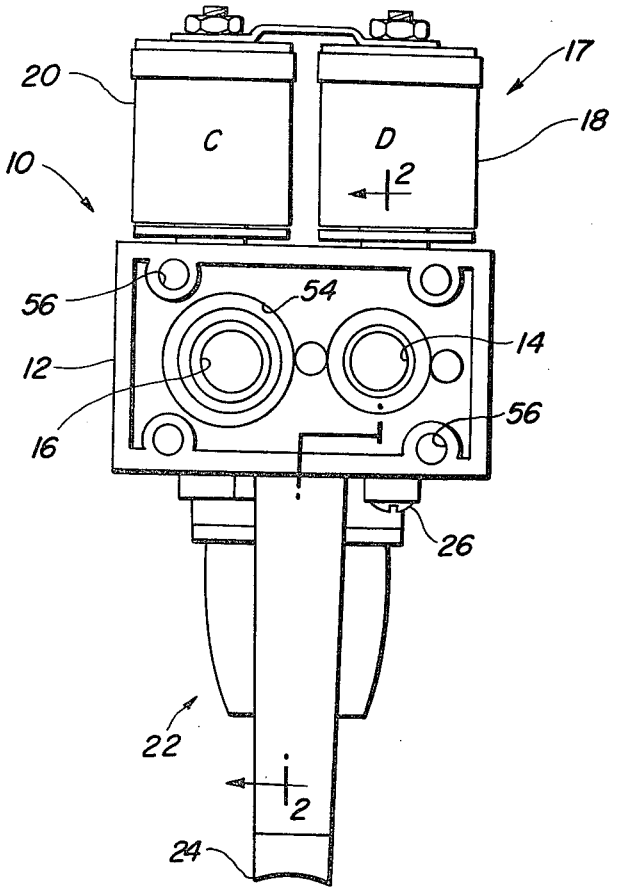
FIG. 1 is a rear view of the valve assembly in the present invention illustrating the diluent and concentrate inlets and the container actuator dispensing lever.

Referring now to FIG. 1, the valve assembly indicated generally at 10 is shown as having a valve body 12 with an inlet 14 for connection to a source of pressurized diluent and a separate inlet 16 spaced therefrom for connection to a source of liquid beverage concentrate. In the presently preferred practice of the invention the valve body 12 is formed of a suitable plastic material capable of being readily molded, as for example, any suitable long chain synthetic polymeric amide commonly known as nylon material. The valve assembly includes power actuator means indicated generally at 17 in the form of a pair of solenoids, with one solenoid 18 operatively connected to a valve member within body 12 for controlling diluent flow as will be hereinafter described in greater detail; and, a second solenoid 20 is operatively connected to a valve member disposed within the body for controlling concentrate flow as will be described hereinafter in greater detail. A removable mixing and dispensing nozzle assembly indicated generally at 22 is provided and described hereinafter in greater detail for mixing diluent and concentrate and dispensing a mixed beverage vertically downward for filling a beverage container (not shown). An actuating lever 24 is disposed vertically downward from the valve body generally parallel to and spaced from the nozzle assembly, the lever being movable upon contact therewith by beverage container (not shown) for actuating a switch (not shown) to energize the solenoids 18 and 20. The nozzle assembly 22 is releasably attached to the body 12 by fastening means, as for example, the screws 26, and is removable therefrom for cleaning and for changing of the concentrate flow control orifice as will be hereinafter described.

Figure 2:
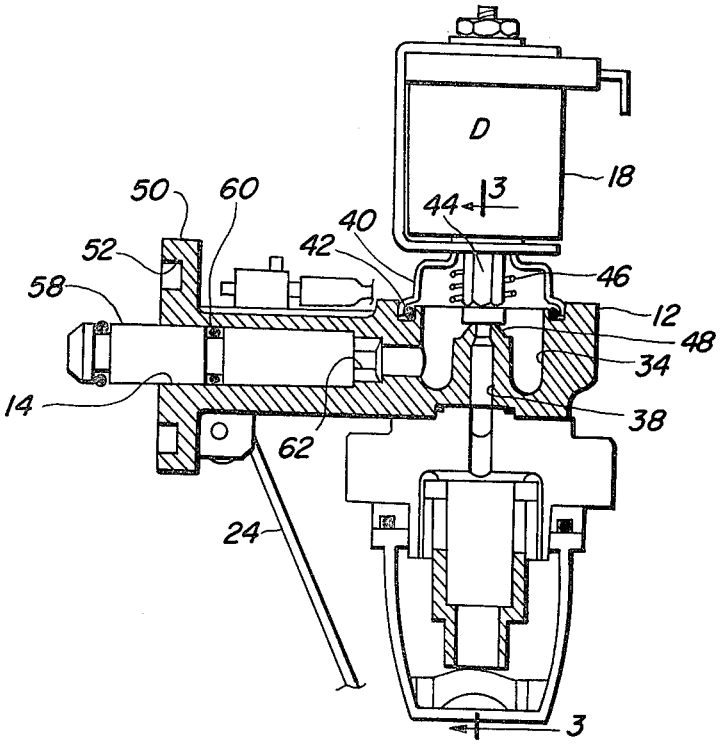
FIG. 2 is a section view taken along section indicating line 2—2 of FIG. 1.
Figure 3:
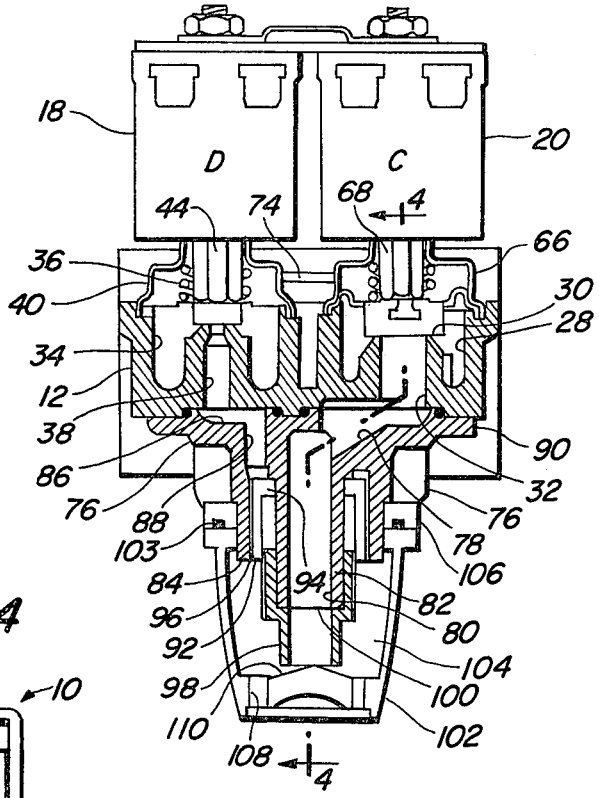
FIG. 3 is a partial section view taken along section indicating line 3—3 of FIG. 2.
Figure 4:
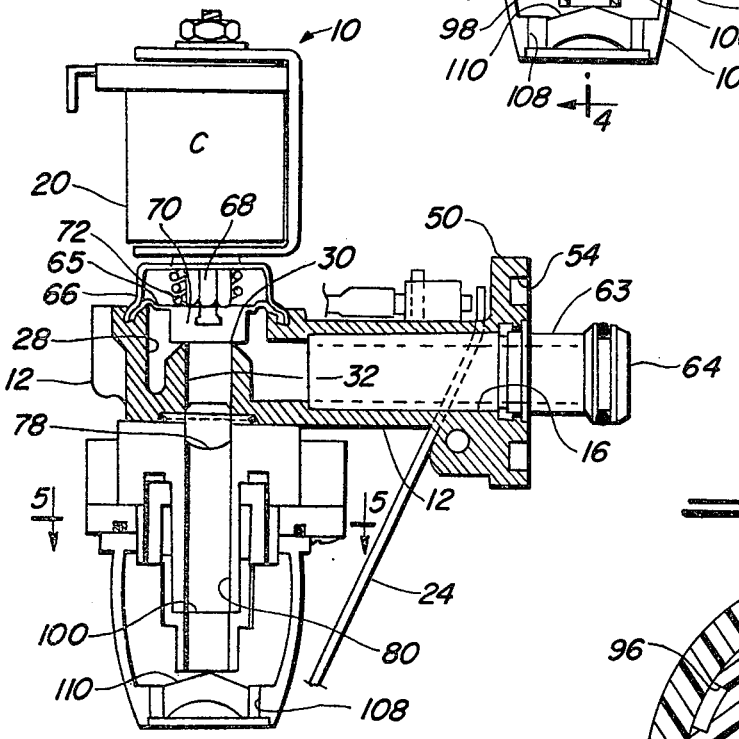
FIG. 4 is a partial section view taken along section indicating line 4—4 of FIG. 3.

Referring now to FIGS. 2, 3 and 4, the interior of the body 12 is shown as having a concentrate valving chamber 28 formed therein and communicating with the concentrate inlet port 16, omitted in FIGS. 2, 3 and 4 for clarity, for receiving therein a flow of concentrate from a source such as a gravity tank. An annular valve seating surface 30 is formed in the concentrate chamber 28, the seating surface 30 having an outlet port 32 formed centrally therethrough to permit flow of concentrate from inlet 16 through chamber 28 and vertically downwardly therefrom.

A diluent valving chamber 34 is formed in body 12 and spaced adjacent the concentrate chamber with the diluent chamber 34 communicating with the diluent inlet 14. The chamber 34 has an annular diluent valve seating surface 36 formed therein, the seating surface having a diluent outlet port 38 formed centrally therein for discharging diluent vertically downwardly from the valving chamber 34.

Referring particularly to FIG. 2, the diluent valving chamber 34 is open to the upper surface of the valve body 12 and has a cover 40 provided thereover and sealed there against by any suitable expedient, as for example, the resilient seal ring 42 and retained thereon preferably by a press fit in a shoulder provided around chamber 34.

A movable armature 44 is received in the chamber 34 and cover 40 and is positioned centrally with respect to diluent solenoid 18 and aligned vertically with the outlet port 38. Cover 40 has an upwardly extending portion (not shown) disposed within the center of solenoid 18 with the upper end of armature 44 slidably received therein and covered thereby. Armature 44 has the lower end thereof in FIG. 2 biased by spring 46 to the closed position in contacting the diluent valve seating surface 36 for preventing flow from chamber 34 through outlet 38. In the presently preferred practice of the invention, the armature is of ferromagnetic material and a resilient sealing pad 48 is provided on the end thereof for effective sealing against valve seating surface 36.

Referring now particularly to FIGS. 2 and 4, the valve body 12 has a mounting flange 50 provided thereon and disposed generally vertically with the valving chamber inlets 14 and 16 extending through the flange and opening outwardly to permit attachment of the valve body to the sources of diluent and concentrate and permit communication with the valve chambers 34, 28 respectively. With reference to FIGS. 1, 2 and 4, the outward face of the flange 50 has provided thereon a seal groove 52 surrounding the diluent inlet 14 for receiving a sealing ring therein. A corresponding groove 54 is provided around the concentrate inlet 16 for similarly receiving a seal ring (not shown) there around. In the presently preferred practice of the invention, the flange 50 has a plurality of apertures 56, shown in FIG. 1, provided therethrough for receiving suitable passing means for attachment of the flange to the source of diluent and concentrate.

Referring particularly to FIG. 2, the diluent inlet port 14 has received therein a tubular insert 58 received therein and sealed there about by any suitable means, as for example, seal ring 60 received in a groove provided in the outer periphery of the tubular member 58. The tubular member 58 extends outwardly of the inlet port 14 and generally at right angles to and beyond the face of the body flange 50 for a suitable distance to provide attachment thereto and heat conduction with the source of diluent. In the presently preferred practice of the invention, the tubular member 58 extends beyond the flange 50 for a suitable distance on the order of two diameters of the tubular member. The member 58 is preferably formed of a suitable corrosion resistant metal such as stainless steel, as for example, AISI Type 304. The member 58 extends inwardly of the port 14 to a position closely adjacent the valving chamber 34 and has a central bore 62 provided therethrough for permitting fluid communication from the tube 58 to the valving chamber. In the presently preferred practice of the invention, the bore 62 is of the order of one-fourth of the outside diameter of the tubular member 58 to provide a massive thick wall to the member 58 for providing the heat sinking ability thereto of maintaining the liquid diluent in the bore 62 at the desired temperature while the liquid is standing in bore 62. The tubular member 58 thus provides for attachment to the source of diluent and for rapid heat transfer relationship thereto to maintain the diluent in the inlet and valving chamber at the desired temperature to insure the desired temperature of the initially dispensed beverage.

Referring now to FIG. 4, the concentrate inlet 16 is shown as similarly having a tubular member 63 received therein and extending to a point closely adjacent the concentrate valving chamber 28 with the inlet end thereof extending outwardly therefrom beyond the flange 50 by a suitable amount on the order of two diameters of the member 58. The tubular member 63 has a central bore 64 provided therethrough for communicating concentrate liquid from the exterior thereof to the concentrate valving chamber 28. The member 63 is also formed of a suitable corrosion resistant metal, preferably stainless steel material, as for example, AISI Type 304, and functions similar to the tubular member 58 to maintain the concentrate received in bore 64 at the desired temperature when no flow is occurring through the valving chamber 28.

The chamber 28 is open to the upper face of the body 12 and has a flexible diaphragm 65 attached circumferentially there around the opening and attached to the valve body in fluid sealing relationship, with the diaphragm covered thereover by a cap 66. The cap has a hollow portion thereof extending upwardly (not shown) and into the center of solenoid 20. A movable armature 68 is received in the cap 66 with the cover end thereof having a resilient valve member 70 attached thereto for movement therewith, with the upper end of armature 68 extending into the center of solenoid 20. The valve member 70 is preferably formed of a suitable resilient material for providing a fluid-tight seal against the seating surface 30 and is biased to the closed position by a spring 72 as shown in FIG. 4.

Referring to FIG. 3, an important aspect of the invention is illustrated, wherein a cross-flow passage 74 is provided between the diluent chamber cover 40 and the concentrate valving chamber cap 66 upstream or above the concentrate valve diaphragm 65. The cross-flow passage 74 permits pressurized diluent to enter the interior of cap 66 and to act upon the surface area of the diaphragm 65 to provide pressure forces thereon for aiding in the closing of the concentrate valve member 70 against valve seating surface 30.

Referring now particularly to FIG. 3, a nozzle attachment block 76 is provided over the lower portion of the valve body 12 and has a concentrate flow passage 78 receiving the flow from concentrate passage 32 in the body 12 and communicating with a vertical concentrate bore 80 provided through a central tubular portion 82 in block 76. Nozzle attachment block 76 has an annular shroud 84 disposed circumferentially about and radially outwardly spaced from the tubular portion 82. A diluent collector passage 86 is formed in the attachment block 76 and receives the flow from diluent outlet 38 in body 12 and the collector passage 86 discharges same through a connecting passage 88 to the annular region intermediate the tubular portion 82 and shroud 84. In the presently preferred practice of the invention, the nozzle attachment block 76 is also formed of a suitable plastic, as for example a readily moldable nylon material.

The nozzle attachment block has a flange portion 90 for registering against the lower surface of body 12, and is retained thereon by any suitable fastening expedient, as for example, self-tapping screws (not illustrated), received through the flange 90 and threadedly engaging the lower portion of body 12.

Figure 5:
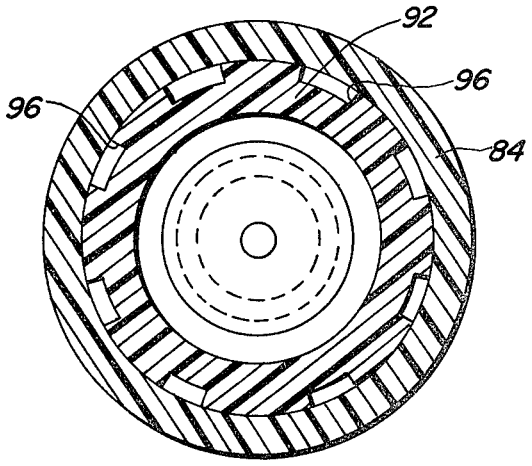
FIG. 5 is a section view taken along section indicating line 5—5 of FIG. 4.

An annular diffuser member 92 is received in a closely fitting relationship in the interior of the annular shroud 84, the diffuser having at its upper end forming a radially inwardly extending flange 94 which flange engages the outer periphery of central tubular portion 82 in a snug fitting relationship preferably taking advantage of the natural mold draft thereof to wedge the diffuser flange 94 thereover. With reference to FIG. 5, the outer periphery of the diffuser 92 is provided with a plurality of axially and downwardly extending, circumferentially spaced grooves 96 for dividing the diluent flow into a plurality of separate streams and diffusing the pressure thereof to substantially atmospheric pressure.

A generally tubular concentrate metering member 98 also formed of a suitable plastic is received over the outer periphery of the central tubular portion 82 in snug fitting engagement, the member 98 having a shoulder provided on the interior thereof with an orifice metering plate 100 registered thereagainst and with the upper surface of the orifice plate 100 also registering against the end of the tubular portion 82 and retained thereagainst by the shoulder 98.

The orifice plate 100 is preferably formed of very thin stainless steel material to provide a knife-edge orifice for metering of concentrate flow. The orifice plate is a slip-fit within the larger inside diameter of the metering member 98 for ease of removal and replacement. When it is desired to change the mix ratio of the beverage, the metering member is removed from the central tube 82 and the orifice plate is removed and replaced with a plate having a differently sized orifice therethrough.

An outer annular nozzle cup or cone 102 surrounds the diffuser and metering member and defines therebetween an annular chamber 104 in which the diluent cascades vertically downward upon discharge from the dividing channels 96 formed in the diffuser. The nozzle cone 102 has a mounting flange 106 provided around the upper periphery thereof for contacting the lower surface of the nozzle attachment block and is sealed thereagainst by seal ring 103 and retained thereagainst by a retaining ring (not shown) attached to the nozzle attachment block by a suitable fastening means, as for example, self-tapping screws. The nozzle cup 80 has the lower, or closed, end thereof provided with a plurality of circumferentially spaced discharge orifices 108 provided therethrough for permitting gravity flow and discharge of the mixed beverage from the annular cascading mixing chamber 104. The central region of the closed end of cup 102 is provided with a generally convex curved surface 110 which directs the flow of concentrate from the orifice plate 100 radially outwardly toward the discharge orifice 108. It is in this region above the discharge orifice 108 that the concentrate is mixed with the cascading shower of diluent from the diffuser passages 96 and flows downward through orifices 108 for collection in a beverage container.

In operation with a source of pressurized diluent connected to the diluent inlet tube 58 (see FIG. 2) and a source of concentrate connected to the concentrate inlet tube 63 (see FIG. 4) the valve assembly is in the inoperative or closed configuration with valving chambers 28, 34 respectively with concentrate and diluent at the desired temperature. The valving chambers are insulated by the surrounding material of valve block 12; and the heat conducting metal inlet tubes 58, 63 maintain the liquid in the valving chambers at the desired temperature. Upon placement of a beverage container against the operating lever 24 (see FIG. 1) and movement thereof, an electric switch (not shown) is actuated thereby energizing the power means 16 by applying electrical energy to the diluent and concentrate solenoid coils 18, 20. Upon energization, the coils 18, 20 attempt to pull the armatures 68, 44 respectively in an upward direction for lifting the valve members from their respective seats. However, the force of the pressurized diluent through cross-flow passage 74 acts upon diaphragm 65 to prevent immediate opening of the concentrate valve. However, the diluent valve is opened immediately permitting flow from chamber 34 through passage 38; and, the consequent pressure drop in chamber 34 bleeds off the pressurized diluent through cross-flow passage 74 from the region above diaphragm 64 thereby permitting the coil 20 to raise the armature 68 and the valve pad 70 from seat 30 to permit concentrate flow through the passage 78. The concentrate then flows downward through passage 80, through orifice plate 100 and is deflected from the surface 110 of the cup radially outwardly for mixing with diluent flowing downward through passage 86, diffuser passages 96 and into the annular region 104. The mixed beverage in chamber 104 then flows downward through passages 108 and discharges from the nozzle assembly.

It will be apparent from the foregoing description that the present valve assembly includes a unique feature by providing chilling tubes in the inlets for the concentrate and diluent to maintain the liquids at the desired chilled temperature in the valving chamber. This insures that after a long dwell period, the initially dispensed drink is at the desired temperature. The valve assembly of the present invention also provides a unique conveniently removable diffuser and mixing nozzle assembly for permitting quick change of orifice plates where it is desired to change the mix ratio of the beverage. The nozzle removal and orifice plate change may be accomplished without disassembling the valve body or disturbing the concentrate or diluent in the valving chambers.

The present invention is uniquely suitable for handling liquid beverage concentrates of the type containing citrus pulp, by virtue of the additional diluent pressure bias force aiding in the closing of the concentrate valve, which pressure bias forces are automatically dissipated upon opening of the diluent valve. It will be understood that this pressure biasing feature is provided in the valve to enable a single valve assembly to be used with a variety of concentrates, such as, sugared syrups for carbonated beverages, fruit juices or citrus concentrates containing solid pulp material. However, it will be understood that where pulp concentrates will not be encountered, that the cross-flow of passage 74 may be omitted and the other features of the invention employed. However, where the cross-flow passage 74 is omitted, the utility of the valve assembly is recognizably decreased since the variety of concentrates which may be used is limited. In the presently preferred practice of the invention the cross-flow passage 74 is employed to provide a valve assembly having the widest degree of usefulness in service and one which may be used with the greatest variety of beverage concentrates.

Having read the foregoing description other modifications and variations of the invention will be apparent to those having ordinary skill in the art, and the invention is limited only by the following claims.

What is claimed is:

1. An electrically operated valve assembly for dispensing a beverage mixed from a gravity supply of liquid concentrate containing pulp and a supply of pressurized diluent, said valve assembly comprising:

(a) body means defining
  (i) a concentrate valving chamber having an inlet adapted for connection to said pulp supply and an outlet, said chamber having a valving surface provided therein;
  (ii) a diluent valving chamber having an inlet adapted for connection to said diluent supply and an outlet, said chamber having a valving surface provided therein; and
  (iii) means defining a cross-flow passage connecting said diluent and pulp passages upstream of said valving surfaces;

(b) a concentrate valve member disposed within said concentrate valving chamber movable between an open position spaced from and a closed position contacting said diluent valving surface;

(c) a diluent valve member disposed within said diluent valving chamber and movable between an open position spaced from and a closed position contacting said diluent valving surface;

(d) means biasing said diluent and concentrate valves to the closed position;

(e) pressure responsive means operative to move said concentrate valve member in response to the pressure differential between said concentrate valving chamber inlet and outlet;

(f) nozzle means including
  (i) means receiving flow by gravity from said concentrate outlet passage and operative to discharge said concentrate vertically downward by gravity and including means defining a knife edge orifice for metering said concentrate flow and
  (ii) means defining an annular flow passage disposed to receive flow from said diluent valving chamber outlet and operative to discharge said diluent vertically downward in an annular shower surrounding said concentrate and for effecting thorough mixing of concentrate and diluent and thereafter discharging the mixture vertically downward;

(g) power means operative upon energization to overcome the force of said bias means to move said diluent and concentrate valve members from the closed to the open position; and (h) wherein said cross-flow passage is operative to permit application of said diluent inlet pressure to said pressure responsive means to increase the bias on said pulp concentrate valve means, and upon opening of said diluent valve, said cross-flow passage permitting bleed-off of the pressure in said pulp concentrate passage inlet to relieve said pressure bias on said pulp concentrate valve member for permitting opening of said pulp concentrate valve by said power means.

2. A valve assembly for dispensing a beverage mixed from a gravity flow of liquid concentrate and a pressurized source of diluent, said assembly comprising:

(a) body means including structure defining a concentrate valving chamber and structure defining a diluent valving chamber with each chamber having an inlet and an outlet for flow therethrough and defining a valve seating surface intermediate the inlet and outlet, said body means further defining a cross-flow passage interconnecting the inlets of said concentrate and diluent chambers;

(b) a movable valve member disposed in each of said chambers, each valve member being movable between a closed position contacting respectively said valve seating surface and an open position spaced respectively from said valve seating surface;

(c) means biasing each of said valve members to the closed position;

(d) power means operable upon energization to overcome said bias means and move each of said valve members from said closed to said open position;

(e) pressure responsive means operative in response to the pressure differential between the inlet and outlet of said pulp passage to apply pressure forces for additionally biasing said pulp concentrate valve member to the closed position, wherein upon opening of said diluent valve, the pressure at the inlet of said pulp valve bleeds off through said cross-flow passage permitting said power means to open said pulp valve; and (f) nozzle means receiving flow from each of said valving chamber outlets and operative to diffuse said diluent to atmospheric pressure and including metering and mixing means operative to mix said concentrate and diluent in a predetermined ratio and dispense a mixed beverage by substantially gravity flow.

3. A valve assembly as claimed in claim 2, wherein the concentrate and diluent are obtained from refrigerated sources and the valve assembly further comprises flow containing means for conveying concentrate and diluent from the respective sources thereof to the corresponding concentrate and diluent valving chamber inlets, said flow containing means being formed of material operative to effect rapid heat transfer therethrough and extending closely adjacent the respective valving chambers to maintain the temperature of concentrate and diluent in said valving chambers near to the temperature of said sources.

* * * * *